US009361815B1

(12) United States Patent
Worsham

(10) Patent No.: US 9,361,815 B1
(45) Date of Patent: Jun. 7, 2016

(54) FLAG ATTACHMENT AND METHOD

(71) Applicant: Jack W. Worsham, Greensboro, NC (US)

(72) Inventor: Jack W. Worsham, Greensboro, NC (US)

( * ) Notice: Subject to any disclaimer, the term of this patent is extended or adjusted under 35 U.S.C. 154(b) by 315 days.

(21) Appl. No.: 13/948,465

(22) Filed: Jul. 23, 2013

(51) Int. Cl.
*G09F 17/00* (2006.01)
*A47K 1/00* (2006.01)

(52) U.S. Cl.
CPC . *G09F 17/00* (2013.01); *A47K 1/00* (2013.01); *Y10T 403/32262* (2015.01); *Y10T 403/32319* (2015.01); *Y10T 403/32368* (2015.01)

(58) Field of Classification Search
CPC ..... G09F 17/00; Y10T 403/32262; Y10T 403/32319; Y10T 403/32368; A47K 1/00
USPC ..... 116/173–174, 28 R; 403/279, 282–283, 403/316–317, 344; 248/207, 214
See application file for complete search history.

(56) References Cited

U.S. PATENT DOCUMENTS

| | | | | | |
|---|---|---|---|---|---|
| 394,983 | A | * | 12/1888 | Hurley | 116/173 |
| 692,153 | A | * | 1/1902 | Lambkin | 402/2 |
| 984,884 | A | * | 2/1911 | Blank | 116/173 |
| 1,062,850 | A | * | 5/1913 | Pratt | 116/174 |
| 1,435,993 | A | * | 11/1922 | Switzer | 116/173 |
| 1,646,467 | A | * | 10/1927 | Walton | 116/174 |
| 1,855,824 | A | * | 4/1932 | Crichton | 116/173 |
| 2,302,524 | A | * | 11/1942 | Borregard | 40/218 |
| 2,799,240 | A | * | 7/1957 | Andrews | 116/174 |
| 2,906,234 | A | * | 9/1959 | Scott | 116/173 |
| 3,706,297 | A | * | 12/1972 | Voorhees | 116/174 |
| 4,603,652 | A | * | 8/1986 | Thibault et al. | 116/174 |
| 4,864,962 | A | * | 9/1989 | Kuehl et al. | 116/174 |
| 5,291,849 | A | * | 3/1994 | Zeitler | 116/174 |
| 5,495,821 | A | * | 3/1996 | Brewer | 116/174 |
| 5,522,342 | A | * | 6/1996 | Chen-Chao | 116/174 |
| 5,943,980 | A | * | 8/1999 | Huang | 116/174 |
| 5,975,009 | A | * | 11/1999 | Nihra et al. | 116/173 |
| 6,389,659 | B1 | * | 5/2002 | Jacobs | 24/573.09 |
| 6,976,447 | B2 | * | 12/2005 | Spiegel | 116/173 |
| 7,017,512 | B2 | * | 3/2006 | Laird et al. | 116/174 |
| 2003/0192467 | A1 | * | 10/2003 | Paris | 116/173 |
| 2005/0098083 | A1 | * | 5/2005 | Petrenko | 116/173 |
| 2011/0162575 | A1 | * | 7/2011 | Jahnz | 116/173 |
| 2012/0111259 | A1 | * | 5/2012 | Swisher et al. | 116/173 |
| 2013/0061797 | A1 | * | 3/2013 | Proctor | 116/173 |

* cited by examiner

*Primary Examiner* — R. A. Smith
*Assistant Examiner* — Tania Courson
(74) *Attorney, Agent, or Firm* — Blake P. Hurt; Tuggle Duggins P.A.

(57) ABSTRACT

An attachment and method of use is described for securing flags, banners and the like to flag poles. The attachment includes a ring having a rotatable pin which fits within a conventional flag grommet. A ring retainer is used to maintain the ring at a selected location along the flag pole. In order for the attachment to work with flag poles having different diameters, a ring retainer spacer and ring spacer are available for easy use during assembly. The attachment allows ease in repositioning the flag along the pole as desired.

15 Claims, 8 Drawing Sheets

FLAG ATTACHMENT AND METHOD

FIELD OF THE INVENTION

The invention herein pertains to flags, banners and the like and particularly pertains to an attachment for easily securing a flag to a standard pole and maintaining the flag in a selected position thereon.

DESCRIPTION OF THE PRIOR ART AND OBJECTIVES OF THE INVENTION

Flags, banners and other articles are often suspended from rods or poles to elevate the flag to a prominent, viewable position. Such flags are usually provided with one or more grommets for attachment and suspension from the flag pole. It is common to use ropes, cords, wires, rings, spring metal clips and similar flexible articles to affix the flag to the pole for temporary or permanent usage. Outdoor flags in use such as by municipalities and residences are often subjected to adverse weather conditions and often undesirably move up or down the flag pole. Thereafter, maintenance or other personnel must then reposition the flag on the pole to its desired location, often times at additional expense to the owner. Further, standard flag pole attachments generally do not have features which allow adjustability for use on various diameter flag poles. Also, conventional flag pole attachments are oftentimes difficult and time consuming to secure in place. Other flag attachments are often expensive and difficult for unskilled workers to effectively use, especially those required to use spring metal clips to engage grommets.

Thus, in view of the problems and disadvantages associated with current methods for attaching and prior flag pole attachments, the present invention was conceived and one of its objectives is to provide a flag attachment and method of use which is simple, convenient and economical for a variety of flag pole diameters.

It is another objective of the present invention to provide a polymeric flag pole attachment which can be varied to accommodate different diameter flag poles.

It is still another objective of the present invention to provide an attachment ring having a rotatable pin for easy insertion through the grommets of a flag which can thereafter be turned to a locked position.

It is yet another objective of the present invention to provide a spacer for the attachment ring which will allow the ring to be used on different flag poles of different diameters.

It is a further objective of the present invention to provide a ring retainer which can be easily positioned in place on the flag pole proximate the attachment ring to prevent it from moving therealong but can be selectively repositioned as needed.

It is yet still another objective of the present invention to provide a spacer for the ring retainer which will allow the ring retainer to be used on different flag poles of different diameters.

It is still a further objective of the present invention to provide a flag pole attachment having various polymeric components which can be easily made and inexpensively sold.

Various other objectives and advantages of the present invention will become apparent to those skilled in the art as a more detailed description is set forth below.

SUMMARY OF THE INVENTION

The aforesaid and other objectives are realized by providing a method of use and a flag pole attachment formed from conventional polymeric materials. The flag pole attachment consists of a ring, a ring spacer, a ring retainer and a ring retainer spacer for adjustably positioning on a flag pole. The ring comprises a pair of arms containing a rotatable pin. The arms of the ring containing the pin are inserted through a typical metal grommet on a flag and the pin is then rotated from a horizontal to a vertical position to provide a stop to maintain the flag in place on the arms. A ring retainer is also provided which can be latched in place using a finger tab and tine. The ring retainer is positioned on the flag pole above or below the ring as necessary to maintain the ring in place. The ring retainer and ring can be moved to reposition the flag along the pole as needed. Should the diameter of the ring be greater than required to fit on the desired pole, a ring spacer is snapped into the ring to lessen the diameter and to make a better fit on a smaller diameter flag pole. The ring spacer includes a plurality of teeth which are flexible for easy manipulation as the spacer is urged into the ring. Flanges on one side of the spacer and lips on the opposing end of the teeth assist to retain the spacer within the ring when in use. To insure the ring retainer properly fits on the flag pole, a ring retainer spacer is also available which, when necessary can be opened and placed on the pole prior to the ring retainer being placed thereover and closed thereon. The retainer spacer includes a flange on the top and bottom to engage the sides of the ring retainer when in use to likewise maintain positioning. As most flags include a pair of grommets another flag pole attachment would be utilized on the second grommet.

A method of attaching a flag to the flag pole using the flag pole attachment as described above is also disclosed.

DETAILED DESCRIPTION OF THE PREFERRED EMBODIMENTS AND OPERATION OF THE INVENTION

Figure 1:
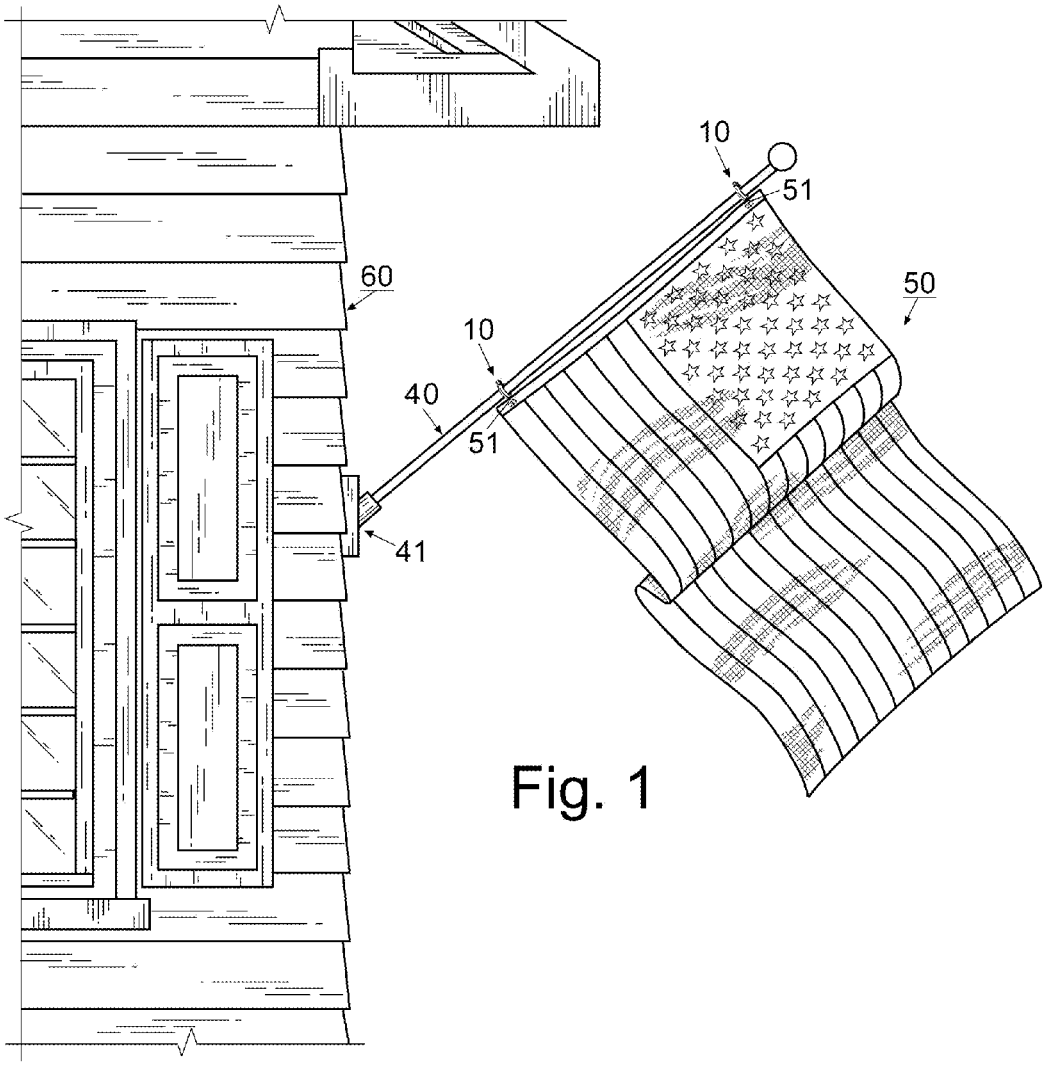
FIG. 1 shows in schematic fashion a flag attached to the flag pole attachments and positioned on a flag pole on a typical building.
Figure 2:
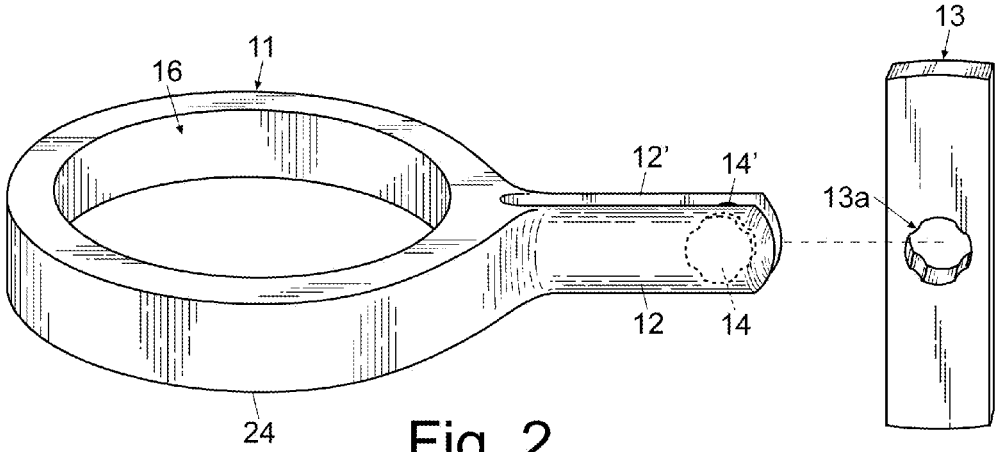
FIG. 2 pictures an enlarged view of the ring with the pin exploded therefrom.
Figure 3:
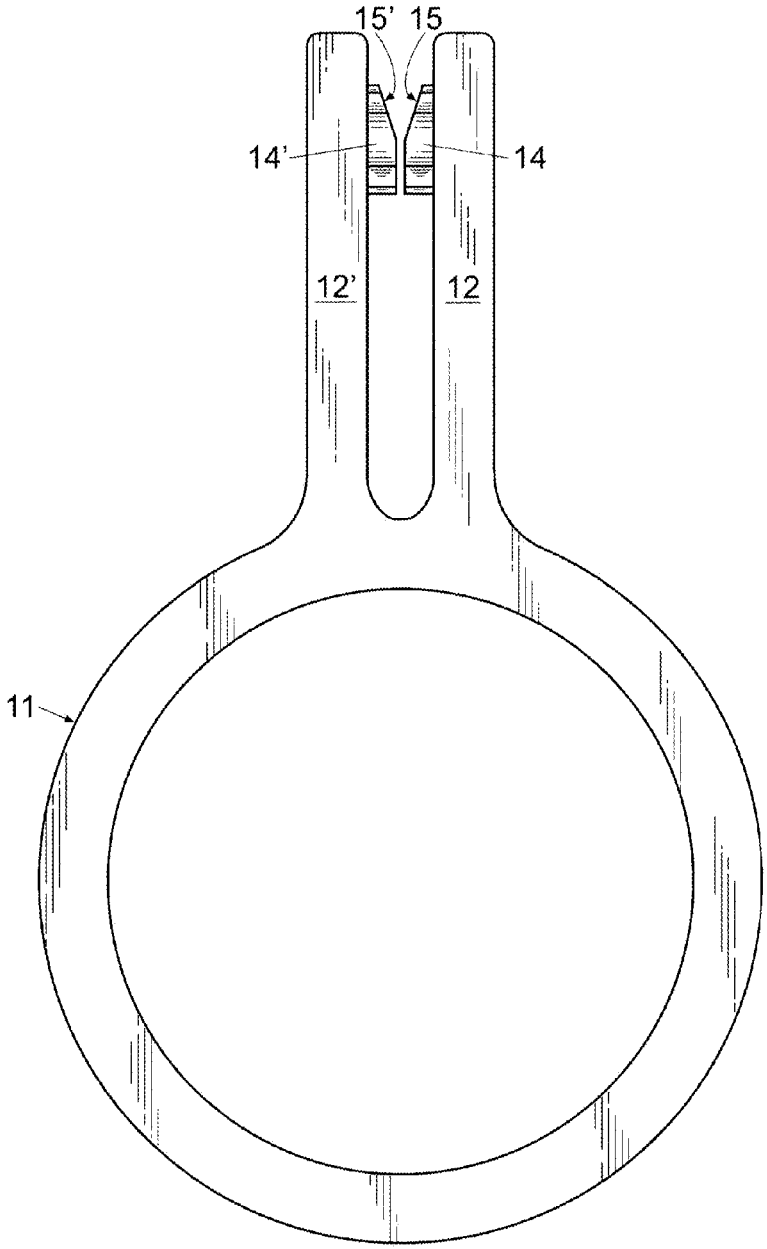
FIG. 3 depicts a top plan view of the ring as seen in FIG. 2 but without the pin.
Figure 5:
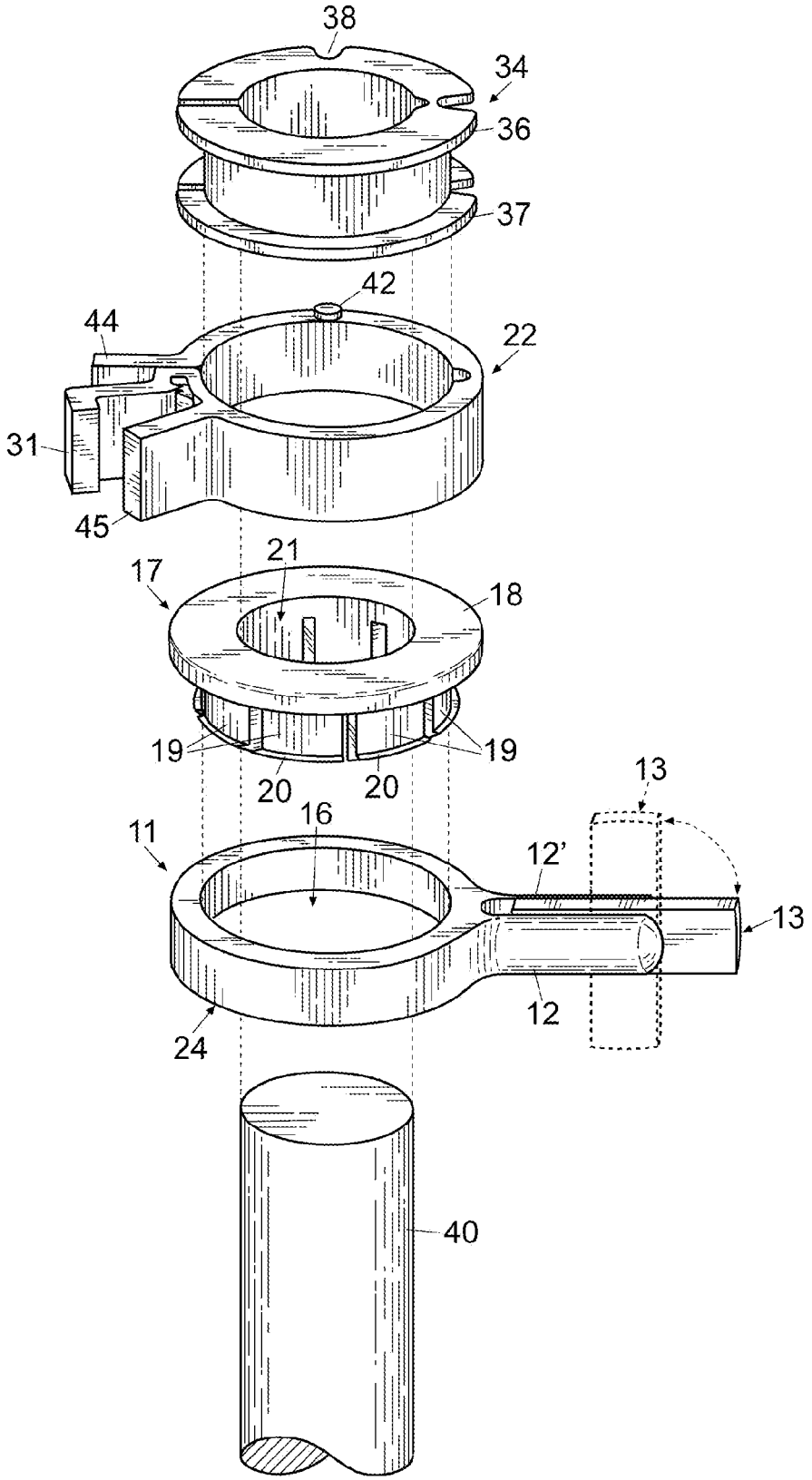
FIG. 5 illustrates an exploded fashion all the components of the invention as removed from the flag pole.

For a better understanding of the invention and its operation, turning now to the drawings, FIG. 1 demonstrates two identical preferred polymeric flag attachments 10 which maintain flag 50 on flag pole 40 on a typical house or other building 60. Flag attachment 10 includes various polymeric components, preferably nylon and as shown in FIG. 2 ring 11 is integrally formed such as by molding with parallel arms 12, 12' having respectively hubs 14, 14' with biased faces 15, 15' as seen in FIG. 3. Pin 13 is shown exploded therefrom and includes hub aperture 13*a* (FIG. 2) formed centrally therein. Pin 13 is rotatably fixed on hubs 14, 14' as seen in FIG. 5 which include biased faces 15, 15' (FIG. 3) to allow pin 13 to easily slide thereon during assembly. Ring 11 is preferably formed from nylon and allows some flexibility as arms 12, 12' open slightly during assembly to allow insertion of pin 13. Hubs 14, 14' have a cross-like shape to accommodate pin aperture 13*a* which has a complimentary cross-like shape as seen in FIG. 2. Thus pin 13 can be manually urged to turn on hubs 14, 14' and lock into place. Pin 13 can be rotated to either a stable open (horizontal) position as shown in FIG. 5 (solid lines) or to a stable locked (vertical) position as shown by dotted lines therein due to the cross-like shape which prevents inadvertent rotation of pin 13. The cross-like shape of hubs 14, 14' and pin aperture 13*a* allows pin 13 to "snap" into position. Finger pressure must then be applied to again rotate pin 13.

Figure 4:
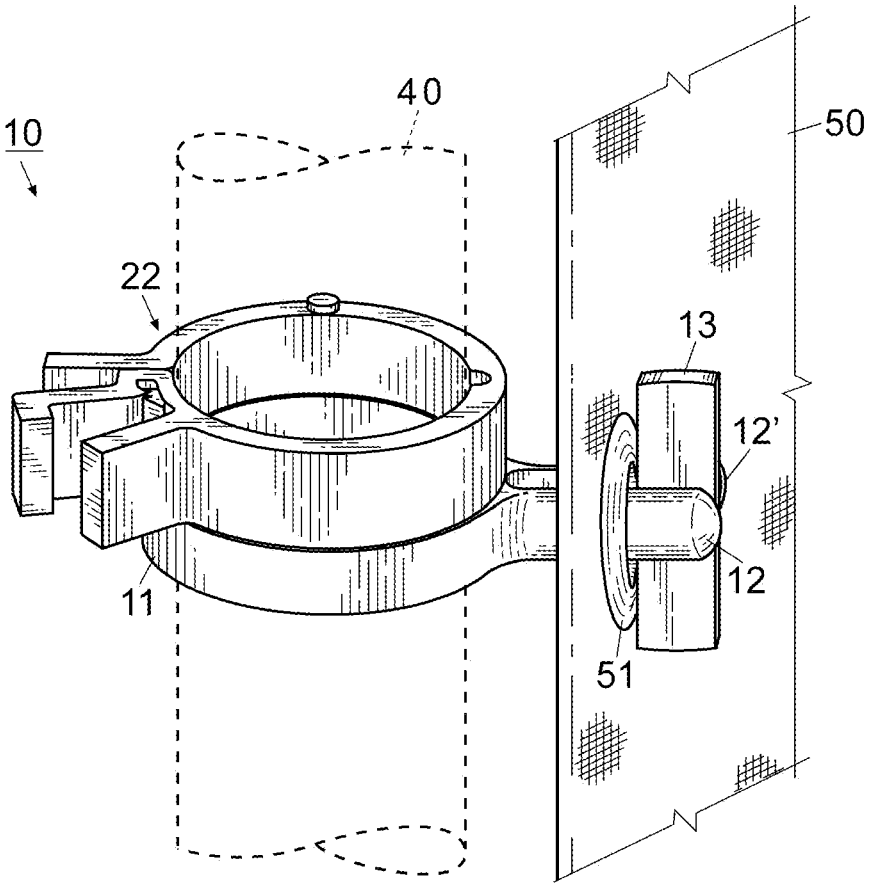
FIG. 4 demonstrates a fragmented flag connected to the ring supported on a pole seen in dashed lines with a ring retainer.
Figure 8:
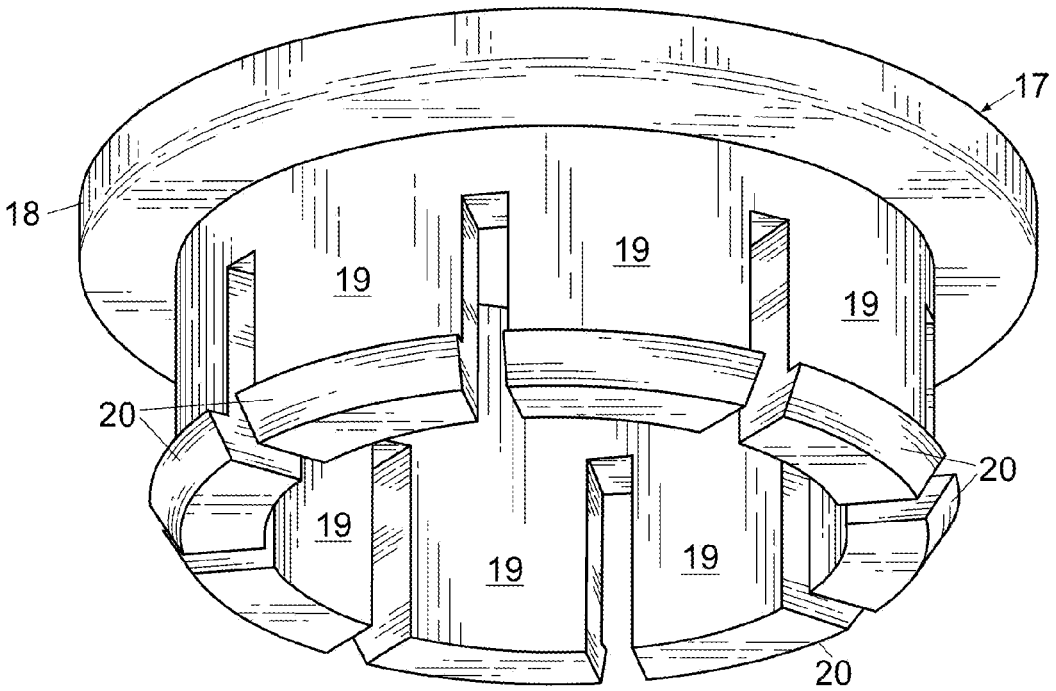
FIG. 8 illustrates an enlarged perspective view of the ring spacer of the invention.

Pole opening 16 of ring 11 (FIG. 2) is sized for effortless sliding along flag pole 40 as shown in FIGS. 1 and 4. However, as flag poles are manufactured in various diameters, the diameter of pole opening 16 can be effectively reduced by insertion of ring spacer 17 shown in FIGS. 5 and 8. Ring spacer 17 includes a continuous upper flange 18 therearound with flexible, depending teeth 19 affixed thereto as seen in an enlarged view in FIG. 8. Each of teeth 19 include lip 20 which engage the lower surface 24 (FIG. 2) of ring 11 when positioned therein to secure ring spacer 17 within ring 11. Ring spacer 17 can be formed with different size internal diameters 21 as shown in FIG. 5 to accommodate various diameter flag poles which may be encountered. Teeth 19 are equally spaced apart and are slightly flexible for easily positioning spacer 17 within ring 11. In use, lips 20 are positioned against ring 11 and by manual pressure ring spacer 17 is then urged into pole opening 16 until it "snaps" completely in place. Once in place ring 11 is engaged between flange 18 and lips 20.

Figure 6A:
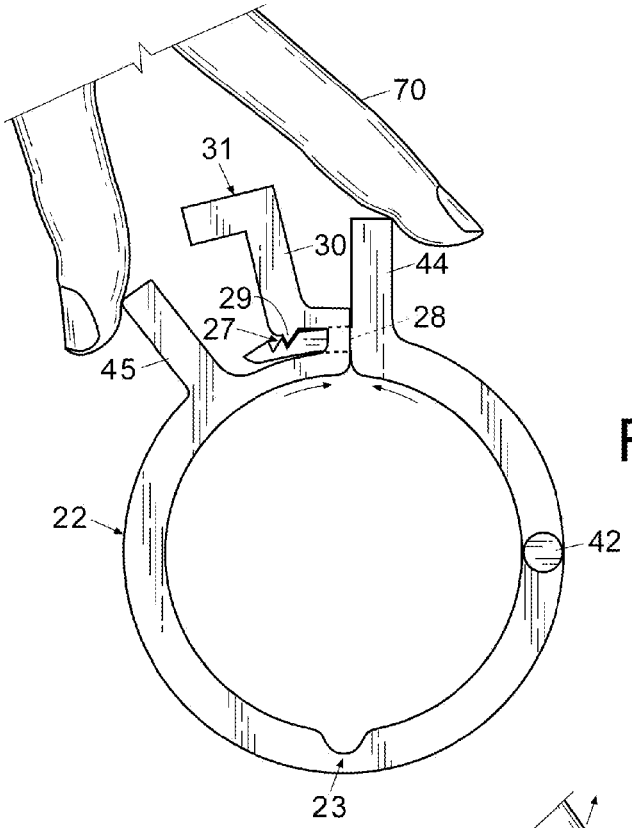
FIG. 6A features the ring retainer being closed and secured by a user's fingers.
Figure 6B:
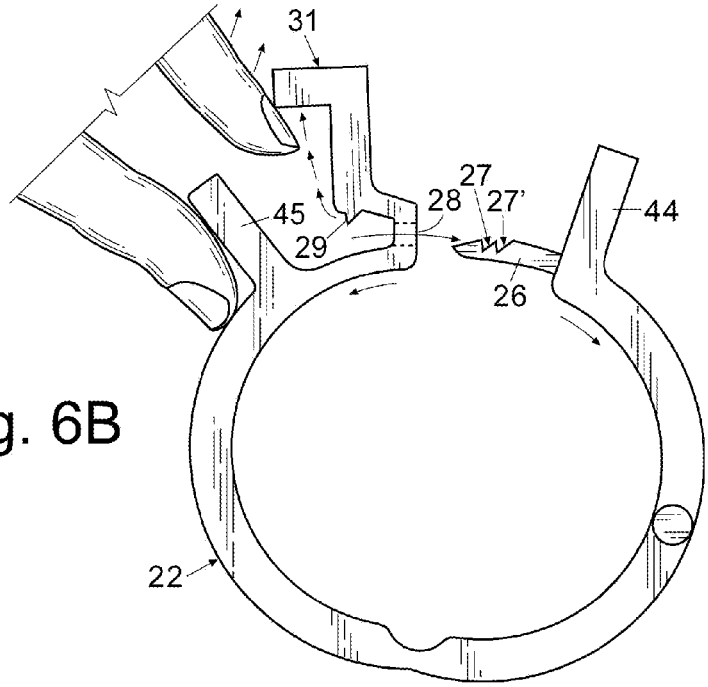
FIG. 6B demonstrates the ring retainer being opened by a user's fingers.
Figure 7:
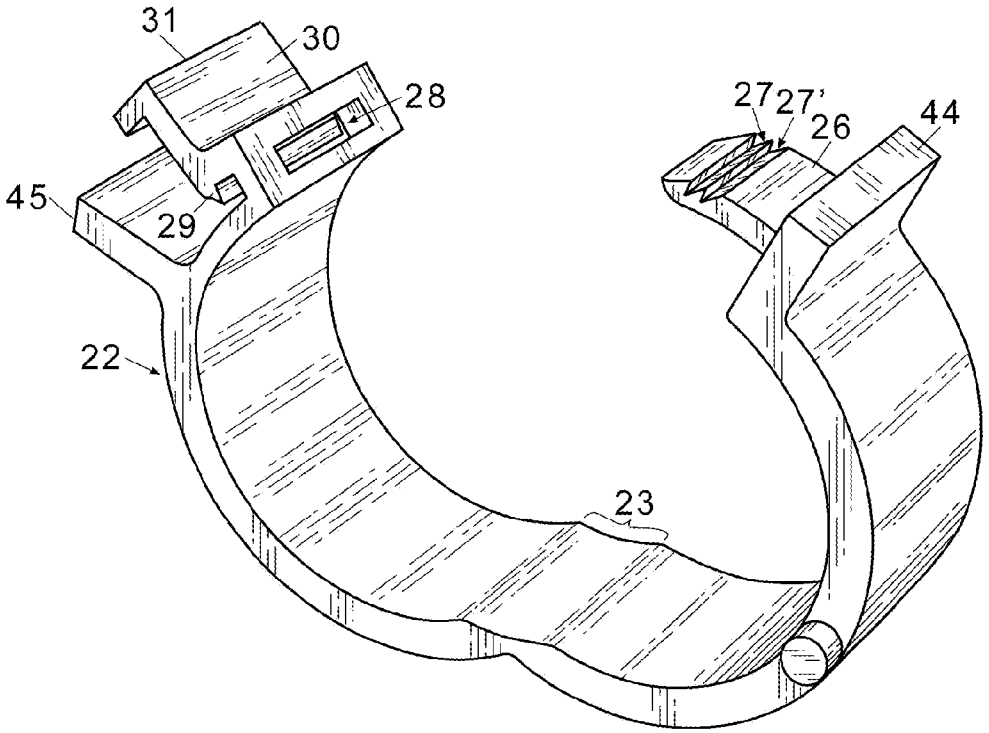
FIG. 7 shows the ring retainer in an open enlarged, perspective view.

Ring retainer 22 is shown in FIGS. 4, 5, 6A, 6B and 7. In FIG. 4 ring retainer 22 is positioned atop ring 11 on flag pole 40 to prevent inadvertent upward movement of ring 11 therealong. Two or more such rings 11 and ring retainers 22 can be utilized as seen for example in FIGS. 1 and 4, such rings are used to maintain flag 50 on flag pole 40. Ring retainer 22 may be placed either above, below or alternately above and below ring 11 to maintain ring 11 in a desired position, and can be easily moved to reposition flag 50 along flag pole 40 as needed. Ring retainer 22 includes hinge area 23 (FIGS. 6A and 7) to allow ring retainer 22 to easily open and close. Ring retainer 22 further includes finger tab 44 and finger tab 31 with vertical stem 30 and tine 29 on one end and finger tab 45 with latch tongue 26 having V-grooves 27, 27' on the opposing end. Finger tab 31 includes latch portal 28 formed therein below stem 30 for receiving latch tongue 26. Along one side of ring retainer 22, stud 42 is integrally formed thereon as seen in FIGS. 5 and 6A between finger tab 45 and hinge area 23. In FIG. 6A, fingers 70 of a user (not seen) urge tabs 44, 45 toward one another to allow latch tongue 26 having v-grooves 27, 27' on tab 45 to pass through latch portal 28 (FIG. 7) to engage tine 29. Tine 29 is integrally formed with vertical latch stem 30 such as during molding. As would be understood finger tab 31 can be urged upwardly and rearwardly as shown in FIG. 6B to disengage tine 29 from grooves 27, 27' to allow opening and removal or replacement of ring retainer 22.

Figure 9:
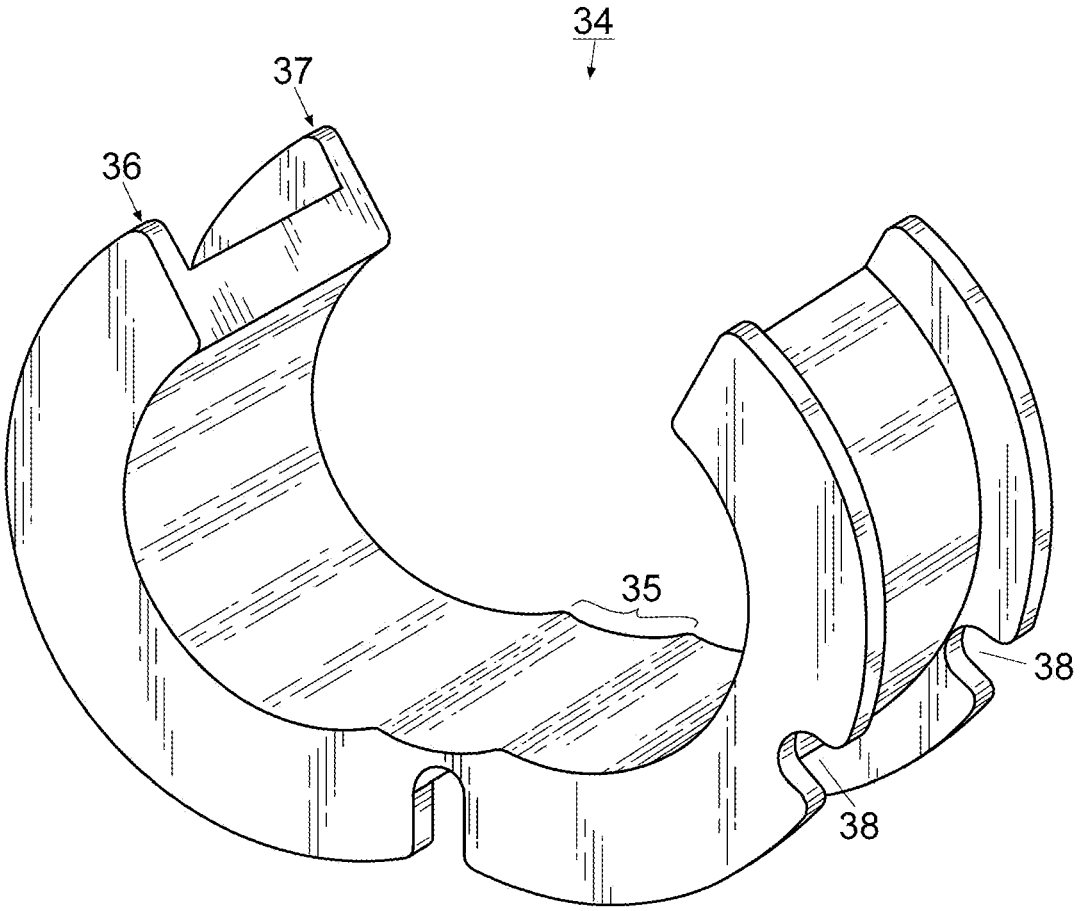
FIG. 9 depicts an enlarged perspective view of the ring retainer spacer of the invention.

Ring retainer spacer 34 is shown in FIG. 9 in an open, perspective view with hinge area 35 integrally formed therewith. Ring retainer spacer 34 is preferably made from nylon or other suitable materials to bend and flex without cracking or breaking. Flanges 36, 37' surround the top and bottom of ring retainer spacer 34 to maintain ring retainer 22 therein. Ring retainer spacer 24 also includes grooves 38 formed in each of flanges 36, 37 for either to receive stud 42 when ring retainer 22 is positioned thereover. Once determined that flag pole 40 has a diameter substantially less than the opening formed by ring retainer 22, ring retainer spacer 34 is required. In use, ring retainer spacer 34 is opened as shown in FIG. 9 and placed on a flag pole such as flag pole 40 (FIG. 5). Once a suitable ring retainer spacer 34 is placed on the flag pole, ring retainer 22 is placed thereover, between flanges 36, 37 whereby stud 42 is received within one of grooves 38. Ring retainer 22 is tightly closed thereon by urging finger tabs 44, 45 together for insertion of tongue 26 through portal 28 as shown in FIG. 6A. Ring retainer 22 is then latched in place as tine 29 engages either V-shaped groove 27 or 27' as required which provides some measure of diameter adjustment for ring retainer 22.

The preferred method of use of the invention allows ease and convenience of attaching a typical flag securely to a flag pole in a stable position and allows the added convenience of repositioning the flag thereon as needed. Further, the method allows for use of ring spacer 17 and ring retainer spacer 34 as needed depending on the diameter of the selected flag pole. One or more flag attachments 10 can be used with a variety of flags such as standard flag 50 provided with a series of grommets 51 therealong. Once a flag pole of suitable diameter is selected, ring 11 is placed on the selected flag pole such as flag pole 40 and pin 13 is rotated to a position parallel to arms 12, 12'. Pin 13 and arms 12, 12' are then inserted through flag grommet 51 and thereafter pin 13 is manually urged to rotate around hubs 14, 14' to an upright or position normal to arms 12, 12'. These steps are repeated until the flag is then secured at each grommet 51 with rings 11. Usually two flag grommets 51 are used to retain flag 50 to flag pole 40.

Depending on the exact configuration of flag pole 40 and stand 41 as seen in FIG. 1, one or more ring retainers 22 as seen in FIG. 4 are positioned on or near ring 11 during assembly to maintain the position of ring 11 on flag pole 40. In alternative methods of hanging a flag, ring spacer 17 can be used for flag poles of smaller diameters by simply inserting ring spacer 17 through pole opening 16 of ring 11 where it is "snapped" therein. Further, should it be desirable to use a spacer for ring retainer 22, retainer spacer 34 is available and can be placed around the pole and thereafter retainer 22 can be placed thereover and latched into place as previously described. Thus the method of suspending a flag from a selected pole can be easily accomplished for poles of various diameters and the flag suspended without concern of high winds or other adverse weather conditions causing the flag to change position along the pole length. Repositioning of the flag along the pole as needed can be easily accomplished by releasing or opening ring retainer 22, slightly moving ring 11 along the flag pole to a desired position, usually without detaching the flag, and then placing ring retainer 22 in its new position proximate ring 11 and thereafter latching ring retainer 22 to secure ring 11 on the flag pole.

The illustrations and examples provided herein are for explanatory purposes and are not intended to limit the scope of the appended claims.

I claim:

1. A flag attachment comprising: a ring, a pair of parallel arms affixed to said ring and extending linearly therefrom, each arm defining a hub with a biased face portion, and a pin defining an opening with a complementary shape relative to said hubs for receiving a portion of each of said hubs therein, said pin rotatably connected between said arms via said hubs and lockable when rotated from a first position to a second, substantially perpendicular position.

2. The flag attachment of claim 1 wherein said ring is sized to slide over a flagpole, said pin sized to slide into a flag grommet.

3. The flag attachment of claim 1 wherein said opening and said hubs each define a complementary cross-like cross-sectional shape.

4. The flag attachment of claim 1 further comprising a spacer, said spacer defining a plurality of downwardly depending teeth, said teeth frictionally engaging said ring to secure said spacer within said ring.

5. The flag attachment of claim 1 further comprising a ring retainer, said ring retainer positioned on a flag pole proximate said ring, a latch defined by a circumferentially extending tongue with a plurality of grooves, a portal sized to receive the tongue therein and formed within a tab having a stem, and a tine extending from said stem to frictional engage at least one of said grooves, said latch attached to said ring retainer for securing said ring retainer proximate said ring.

6. The flag attachment of claim 5 wherein said ring retainer further comprises a hinge, said hinge integral said ring retainer.

7. The flag attachment of claim 5 further comprising a ring retainer spacer, said ring retainer spacer comprising a band, said band openable to allow placement on said pole circumscribed by said ring retainer.

8. The flag attachment of claim 7 wherein said ring retainer spacer further comprises a hinge, said hinge integral said band.

9. The flag attachment of claim 1 further comprising a spacer, said spacer comprising a plurality of flexible teeth engaging said ring to secure said spacer within said ring, a ring retainer, said ring retainer positioned proximate said ring on a pole, a latch defined by a circumferentially extending tongue with a plurality of grooves, a portal sized to receive the tongue therein and formed within a tab having a stem, and a tine extending from said stem to frictional engage at least one of said grooves, said latch attached to said ring retainer for securing said ring retainer proximate said ring on said pole, said ring retainer comprising a hinge, said hinge integral said ring retainer.

10. A method of attaching a flag to a flagpole comprising the steps of:

a) providing a flag with a grommet, a flagpole and a ring with a pivotable pin rotatably mounted to an arm defining a hub with a biased face portion;

b) inserting the pin through the grommet;

c) sliding the ring over the flagpole; and d) rotating the pin from a first, unlocked position to a second and perpendicular locked position.

11. The method of claim 10 wherein the step of providing a ring comprises the step of providing a ring with a spacer attached.

12. The method of claim 10 wherein sliding the ring over the flagpole further comprises the step of placing a ring retainer on the flag pole to selectively secure the ring along the flagpole.

13. The method of claim 12 wherein placing the ring retainer on the ring further comprises the step of latching the ring retainer.

14. The method of claim 13 further comprising the steps of:

a) unlatching the ring retainer;

b) moving the flag along the flag pole; and c) latching the ring retainer in a new position on the flag pole.

15. A flag attachment positioned on a flag pole for holding a flag, the attachment comprising, a polymeric ring with planar lateral sides, the ring defining a pair of parallel arms extending integrally from an exterior surface of the ring in a linear orientation, each arm defining a rounded terminal end and a cross-shaped opening positioned proximal the rounded terminal end, each arm defining an inward facing hub with a longitudinally extending biased face portion, each hub defining a cross-like cross-sectional shape, a generally rectangular pin defining a central opening with a complementary, cross-like cross-sectional shape relative to said hubs for receiving a portion of each of the hubs therein, the pin rotatably connected between the arms via the hubs and lockable when rotated from a first position to a second, substantially perpendicular position, a circular spacer defining a plurality of teeth extending in a downward direction from a flange portion relative to the ring, each tooth defining an outward extending lip positioned at a distal end of the tooth relative to the flange, the plurality of teeth frictionally engaged via the lips to a ring lower surface to secure the spacer within an inner circumference of the ring, a ring retainer positioned in abutting relationship to the ring, the ring retainer including first, second, and third stem members, the second stem member defining a perpendicular tab portion relative to the stem, a latch defined by a circumferentially extending tongue mounted to the third stem and including a plurality of grooves, a portal defined by the second stem sized to receive the tongue therein, and a tine extending from an end of the second stem opposite the tab to frictional engage at least one of the tongue grooves, the latch attached to the ring retainer circumferentially opposite an integral hinge for securing the ring retainer proximate the ring, the ring retainer including a stud extending from a first planar lateral side of the ring retainer in opposing relation to a second planar lateral side more proximal the ring, and a circular ring retainer spacer with top and bottom flanges opposingly attached to a band including an integrally formed hinge, the top and bottom flanges each defining aligned grooves.

* * * * *